US008296988B2

(12) United States Patent
Yale et al.

(10) Patent No.: US 8,296,988 B2
(45) Date of Patent: Oct. 30, 2012

(54) FIREARM SUPPORTING DEVICES, METHODS OF ASSEMBLING FIREARM SUPPORTING DEVICES, AND METHODS OF PACKAGING FIREARM SUPPORTING DEVICES

(75) Inventors: Dave Yale, Santa Clara, CA (US); Russell A. Potterfield, Columbia, MO (US); Tim Morrow, Jefferson City, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 11/607,550

(22) Filed: Nov. 30, 2006

(65) Prior Publication Data

US 2008/0127815 A1 Jun. 5, 2008

(51) Int. Cl.
*F41C 27/00* (2006.01)

(52) U.S. Cl. ..... 42/94; 73/167

(58) Field of Classification Search ..... 42/94; 73/167
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |

(Continued)

FOREIGN PATENT DOCUMENTS

| | | |
|---|---|---|
| DE | 838872 | 5/1952 |

(Continued)

OTHER PUBLICATIONS

U.S. Appl. No. 11/431,956, filed May 10, 2006, Morrow et al.

(Continued)

*Primary Examiner* — Michael Carone
*Assistant Examiner* — Samir Abdosh
(74) *Attorney, Agent, or Firm* — Perkins Coie LLP

(57) ABSTRACT

Firearm supporting devices (e.g., firearm vises), methods of assembling firearm supporting devices, and methods of packaging firearm supporting devices are disclosed herein. One aspect is directed to a firearm supporting device for supporting a firearm having a first section and a second section spaced apart from the first section. In one such embodiment, a firearm supporting device includes a base, a first support for carrying the first section of the firearm, and a second support for carrying the second section of the firearm. The base includes a first portion and a second portion configured to be attached to the first portion. The first portion is fixed relative to the second portion when the first and second portions are attached. The first support is configured to project from the first portion of the base. The second support is configured to project from the second portion of the base.

25 Claims, 5 Drawing Sheets

U.S. PATENT DOCUMENTS

| | | | |
|---|---|---|---|
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,378,545 | A | 6/1945 | Fraser et al. |
| D147,305 | S | 8/1947 | Sloan |
| 2,427,365 | A | 9/1947 | Meister |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthorne |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,013,289 | A | 12/1961 | Sasena |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,358,504 | A | 12/1967 | Freebairn |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman, Sr. |
| 3,804,238 | A | 4/1974 | Howard |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,876,078 | A | 4/1975 | Gomes et al. |
| 3,877,178 | A | 4/1975 | Campanelli |
| 3,878,939 | A | 4/1975 | Wilcox |
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |
| 3,899,797 | A | 8/1975 | Gunst |
| D237,106 | S | 10/1975 | Baljet et al. |
| 3,913,746 | A | 10/1975 | Burton |
| 3,914,879 | A | 10/1975 | Taylor, III et al. |
| 3,935,657 | A | 2/1976 | Wade |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,021,971 | A | 5/1977 | McFadden |
| 4,026,057 | A | 5/1977 | Cady |

4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A * 10/1985 Rickling ..... 269/156
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,716,673 A 1/1988 Williams et al.
4,721,205 A 1/1988 Burt et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A * 3/1991 Lund ..... 42/94
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A * 10/1991 Minneman ..... 42/94
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A * 1/1992 Jarvis ..... 42/94
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,344,012 A 9/1994 Matthews
5,347,740 A 9/1994 Rather et al.
5,351,428 A 10/1994 Graham 5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,704,482 A 1/1998 Apps et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,758,933 A 6/1998 Clendening
5,761,954 A 6/1998 Dvorak
5,778,589 A * 7/1998 Teague ..... 42/94
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick, Jr.
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
D540,904 S 4/2007 Werner
7,207,567 B1 4/2007 Brown
7,213,494 B2 5/2007 James
7,225,050 B2 5/2007 Sutula, Jr.
D553,219 S 10/2007 Potterfield
7,281,346 B1 10/2007 Cook et al.
D567,895 S 4/2008 Cauley
7,356,961 B2 4/2008 Williams
7,357,250 B2 4/2008 Hagemann et al.
7,363,740 B2 4/2008 Kincel
7,367,451 B2 5/2008 Pendergraph et al.
7,401,431 B2 7/2008 Pierce et al.
D576,245 S 9/2008 Potterfield et al.
7,421,815 B1 9/2008 Moody et al.

| | | | | |
|---|---|---|---|---|
| 7,426,800 | B2 | 9/2008 | Pierce et al. | |
| 7,584,690 | B2 | 9/2009 | Cauley | |
| 7,631,455 | B2 | 12/2009 | Keng et al. | |
| 7,676,977 | B1 | 3/2010 | Cahill et al. | |
| 7,726,478 | B2 | 6/2010 | Potterfield et al. | |
| 7,730,824 | B1 | 6/2010 | Black | |
| 8,011,129 | B2 | 9/2011 | Cauley et al. | |
| 2002/0113372 | A1 | 8/2002 | Love | |
| 2002/0195752 | A1 | 12/2002 | Yang | |
| 2003/0079395 | A1 | 5/2003 | Chong | |
| 2004/0020097 | A1* | 2/2004 | Deros | 42/94 |
| 2004/0112777 | A1 | 6/2004 | Huang | |
| 2004/0134113 | A1* | 7/2004 | Deros et al. | 42/94 |
| 2005/0000141 | A1 | 1/2005 | Cauley et al. | |
| 2005/0011101 | A1 | 1/2005 | Gooder | |
| 2005/0115137 | A1* | 6/2005 | Minneman | 42/94 |
| 2005/0178039 | A1 | 8/2005 | Flores | |
| 2005/0183319 | A1 | 8/2005 | Franks | |
| 2005/0188597 | A1 | 9/2005 | Keng et al. | |
| 2005/0242250 | A1 | 11/2005 | Keng et al. | |
| 2006/0174532 | A1 | 8/2006 | Popikow | |
| 2006/0175213 | A1 | 8/2006 | Hurt et al. | |
| 2006/0218840 | A1* | 10/2006 | Cauley | 42/94 |
| 2006/0236584 | A1 | 10/2006 | Williams | |
| 2006/0248774 | A1 | 11/2006 | Pierce et al. | |
| 2006/0248775 | A1 | 11/2006 | Wade et al. | |
| 2006/0254111 | A1 | 11/2006 | Giauque et al. | |
| 2006/0277811 | A1 | 12/2006 | Peterson | |
| 2006/0278797 | A1 | 12/2006 | Keng et al. | |
| 2007/0029733 | A1 | 2/2007 | Anderson | |
| 2007/0046760 | A1 | 3/2007 | Zara | |
| 2007/0051028 | A1 | 3/2007 | Stordal | |
| 2007/0068379 | A1 | 3/2007 | Sween et al. | |
| 2007/0068835 | A1 | 3/2007 | Buie | |
| 2007/0074439 | A2* | 4/2007 | Cauley et al. | 42/94 |
| 2007/0074440 | A2* | 4/2007 | Cauley | 42/94 |
| 2007/0094911 | A1 | 5/2007 | Rush et al. | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 | 11/2007 | Gamez et al. | |
| 2007/0266610 | A1 | 11/2007 | Coffield | |
| 2007/0294929 | A1 | 12/2007 | Potterfield et al. | |
| 2007/0294930 | A1 | 12/2007 | Mays | |
| 2007/0295197 | A1 | 12/2007 | Potterfield | |
| 2008/0023379 | A1 | 1/2008 | Potterfield et al. | |
| 2008/0023915 | A1 | 1/2008 | Morrow et al. | |
| 2008/0034636 | A1* | 2/2008 | Potterfield et al. | 42/94 |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0128002 | A1 | 6/2008 | Jeffs | |
| 2008/0156671 | A1 | 7/2008 | Jansson | |
| 2008/0163534 | A1 | 7/2008 | Lombardi | |
| 2008/0168697 | A1* | 7/2008 | Potterfield et al. | 42/94 |
| 2008/0174071 | A1 | 7/2008 | Potterfield et al. | |
| 2009/0049731 | A1 | 2/2009 | Seuk | |
| 2009/0056192 | A1 | 3/2009 | Oz | |
| 2009/0126250 | A1 | 5/2009 | Keng | |
| 2010/0102178 | A1 | 4/2010 | Smith et al. | |
| 2010/0116163 | A1 | 5/2010 | Zara | |
| 2011/0024985 | A1 | 2/2011 | Potterfield et al. | |
| 2011/0036236 | A1 | 2/2011 | Potterfield et al. | |
| 2011/0079524 | A1 | 4/2011 | Potterfield et al. | |
| 2011/0225788 | A1 | 9/2011 | Potterfield et al. | |
| 2012/0085012 | A1 | 4/2012 | Potterfield et al. | |

FOREIGN PATENT DOCUMENTS

| | | |
|---|---|---|
| EP | 0624455 | 11/1994 |
| GB | 475080 | 11/1937 |

OTHER PUBLICATIONS

U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo Wii, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj..., 3 pgs, the date on which The Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4" Targets.
Caldwell™ Shooting Supplies, Targets & Target Accessories, Instra-View™ Targets, 1 page.
Californiavarmintcallers.com—Forum, http://californiavarmintcallers.com/community/modules/newbb/viewtopic.php?topic_id=10&forum=9&PHPSESSID=074ed8c7..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].

Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2, date unknown.
Caldwells Insta-View 4" Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual Number Ten for Rifle and Pistol," The Cartridge Components, SPEER Omark Industries, pp. 28-54.
"Shotshell reloading with a GRABBER 76," MEC—Mayville Engineering Company, Inc., pp. 1-12.
Sweeney, P "Gunsmithing: Measure Headspace," Peterson's Rifleshooter, http://www.rifleshootermag.com/gunsmithing/headspace_0612/, 4 pages. [Internet Accessed Dec. 11, 2004].
Tenex Precision Co., "Recoil A-Rest-R," 4 pages, date unknown [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
Device manufactured by Shooter's Ridge, a division of ATK, and available at least by late 2005, 1 page.
"Uncle Bud'S Udder Bag," http:www.unclebudscss.com/pages/Udder%20Bags.html, 2 pgs. [Internet accessed on Feb. 14, 2006].
"Uncle Bud'S Bull Bags," http:www.unclebudscss.com/pages/Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id= ..., 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabelas/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].

MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Amazon.com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup_2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5-7gnY4CFRVNhgodjFhfSQ, 29 pages [Internet accessed on Aug. 30, 2007].
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
U.S. Appl. No. 12/209,113, filed Sep. 11, 2008, Potterfield et al.
U.S. Appl. No. 12/276,223, filed Nov. 21, 2008, Potterfield et al.
U.S. Appl. No. 12/276,229, filed Nov. 21, 2008, Cauley et al.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
RCBS, "Reloading Equipment," http:///www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
U.S. Appl. No. 12/476,041, filed Jun. 1, 2008, Cauley.
U.S. Appl. No. 12/578,393, filed Oct. 13, 2009, Morrow et al.
U.S. Appl. No. 12/623,238, filed Nov. 20, 2009, Potterfield.

* cited by examiner

FIREARM SUPPORTING DEVICES, METHODS OF ASSEMBLING FIREARM SUPPORTING DEVICES, AND METHODS OF PACKAGING FIREARM SUPPORTING DEVICES

TECHNICAL FIELD

The present disclosure is directed to firearm supporting devices, methods of assembling firearm supporting devices, and methods of packaging firearm supporting devices.

BACKGROUND

Rifles, shotguns, and other firearms can be held by hand or placed in a standard shop vise for cleaning and maintenance. Although placing the firearm in a shop vise is more secure than holding the firearm with one hand, a shop vise has several drawbacks. For example, a standard shop vise has metal jaws or clamping surfaces that must be covered with a softer material to avoid damaging the firearm. Often these jaw coverings are either not installed or fall off the vise after installation, resulting in damage to the firearm. Moreover, a standard shop vise clamps the firearm at a single point on the firearm. Because the vise clamps the firearm at only one point, the pressure at this point to effectively hold and secure the firearm must often be so great that the vise damages the firearm.

To address these concerns, several conventional firearm vises have been developed that support a firearm at two different points. These firearm vises, however, are bulky devices with a large length and height. As a result, the firearm vises are expensive to ship because shipping rates are based in part on the volume of a package. Not only are conventional firearm vises expensive to ship, but they are also cumbersome to store and transport due to the bulky size. Accordingly, there exists a need to improve conventional firearm vises.

DETAILED DESCRIPTION

A. Overview

Figure 1:
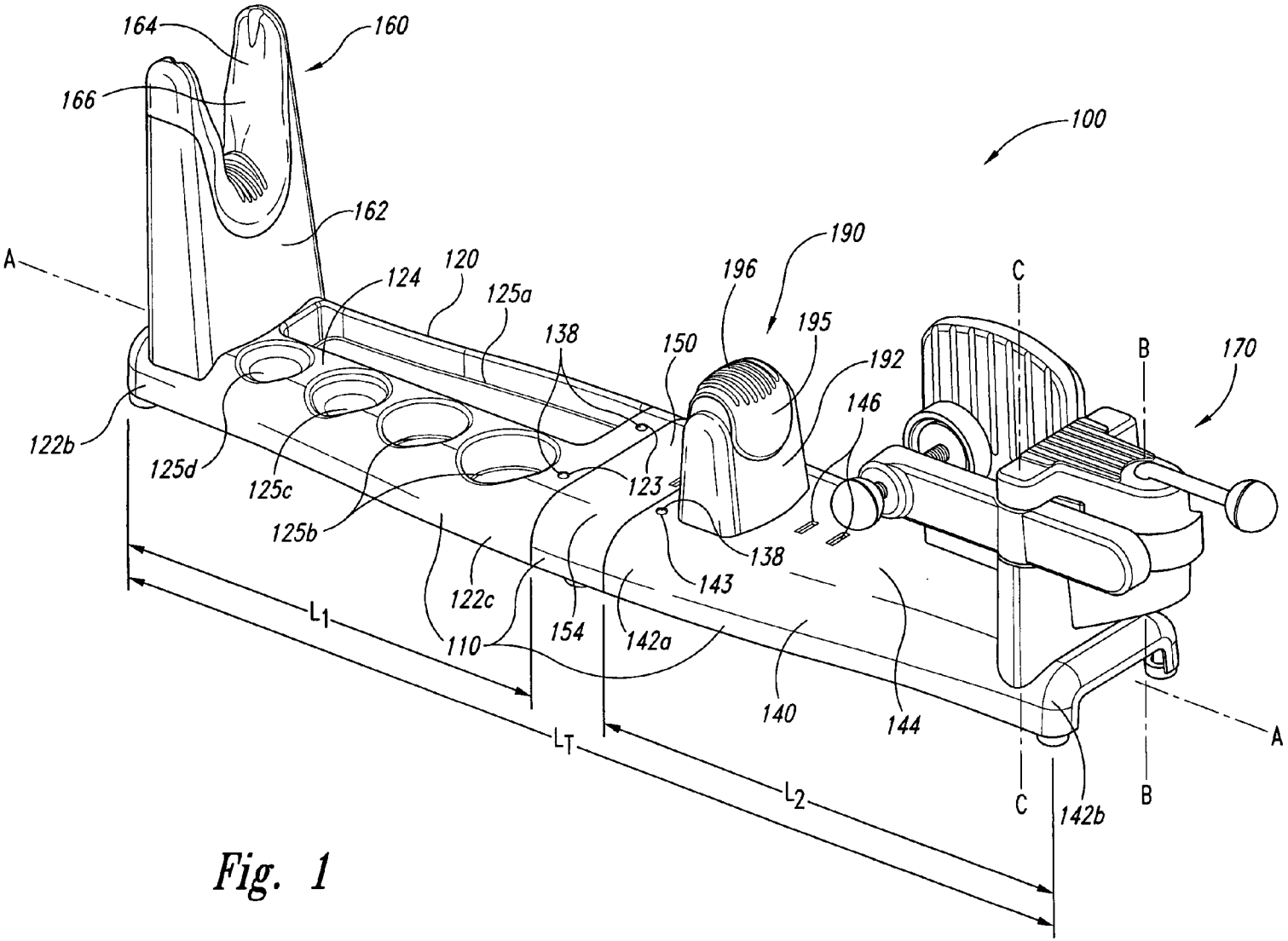
FIG. 1 is a schematic isometric view of a firearm supporting device in accordance with one embodiment of the invention.

The following disclosure describes several embodiments of firearm supporting devices (e.g., firearm vises), methods of assembling firearm supporting devices, and methods of packaging firearm supporting devices. One aspect of the invention is directed to a firearm supporting device for supporting a firearm having a first section and a second section spaced apart from the first section. In one embodiment, a firearm supporting device includes a base, a first support for carrying the first section of the firearm, and a second support for carrying the second section of the firearm. The base includes a first portion and a second portion configured to be attached to the first portion. The first portion is fixed relative to the second portion when the first and second portions are attached. The first support is configured to project from the first portion of the base. The second support is configured to project from the second portion of the base.

In another embodiment, a firearm supporting device includes a base having a first portion and a second portion attached to the first portion. The first portion has a first length and the second portion has a second length. The base has a minimum length greater than both the first and second lengths when the first portion is attached to the second portion. The supporting device further includes a first support attached to the first portion of the base and a second support attached to the second portion of the base. The first support is configured to support the first section of the firearm, and the second support is configured to support the second section of the firearm.

In another embodiment, a firearm supporting device includes a base having a first portion and a second portion attachable to the first portion. The supporting device further includes a first support attachable to the first portion and a second support attachable to the second portion. The first support is configured to support the first section of the firearm. The second support includes a clamp assembly having a cam and a cam follower positioned proximate to the cam. The clamp assembly is configured to contact the second section of the firearm and selectively inhibit movement of the second section of the firearm relative to the second portion of the base.

Another aspect of the invention is directed to methods of assembling firearm supporting devices for supporting firearms having a first section and a second section spaced apart from the first section. In one embodiment, a method includes attaching a first portion of a base to a second portion of the base such that the first portion is fixed along a longitudinal axis of the base relative to the second portion. The method further includes connecting a first support for carrying the first section of the firearm to the first portion of the base, and coupling a second support for carrying the second section of the firearm to the second portion of the base.

Another aspect of the invention is directed to methods of packaging firearm supporting devices for supporting firearms having a first section and a second section spaced apart from the first section. In one embodiment, a method includes providing a first portion of a base, a second portion of the base configured to attach to the first portion, a first support configured to project from the first portion and support the first section of the firearm, and a second support configured to project from the second portion and support the second section of the firearm. The method further includes placing the first and second portions of the base and the first and second supports in a container with the first and second portions of the base detached from each other.

Specific details of several embodiments of the invention are described below with reference to firearm supporting devices for supporting firearms. Several details describing well-known structures or processes often associated with firearms and firearm supporting devices are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-5. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Firearm Supporting Devices

FIG. 1 is a schematic isometric view of a firearm supporting device 100 in accordance with one embodiment of the invention. The illustrated supporting device 100 can support and/or secure a firearm (e.g., a rifle or shotgun) at three points on the firearm for cleaning, maintenance, repair, modification, or other purposes. Specifically, the illustrated supporting device 100 includes a base 110, a first support 160 for carrying a forward section of the firearm, a second support 170 for carrying a rearward portion of the firearm, and a third support 190 for carrying an intermediate section of the firearm. For example, the first support 160 can support the forestock of a rifle, the second support 170 can support the buttstock of the rifle, and the third support 190 can support the stock of the rifle behind the trigger guard. In other embodiments, however, the supporting device 100 may not include the third support 190.

The illustrated base 110 has a longitudinal axis A-A, a first portion 120 attached to the first support 160, a second portion 140 attached to the second support 170, and a third portion 150 attached to and positioned between the first and second portions 120 and 140. The first, second, and third portions 120, 140, and 150 are separate and distinct components of the base 110 that can be assembled and attached together for use. For example, in several embodiments, the first, second, and third portions 120, 140, and 150 are configured to be releasably connected such that the portions 120, 140, and 150 can be detached from each other for storage, transport, shipping, or other purposes. In other embodiments, the first, second, and third portions 120, 140, and 150 can be configured to be non-releasably attached together such that the portions 120, 140, and 150 are assembled together and not disconnected. In either case, when the first, second, and third portions 120, 140, and 150 are attached together, the portions 120, 140, and 150 are fixed and non-movable relative to each other.

The first portion 120 of the base 110 has a length $L_1$, a longitudinal axis generally coaxial with the axis A-A of the base 110, a first end section 122*a* attached to the third portion 150, a second end section 122*b* opposite the first end section 122*a*, and an upper surface 124. The illustrated upper surface 124 includes numerous cavities, depressions, or recesses of specific sizes and shapes corresponding to common firearm cleaning supplies and maintenance tools. For example, the upper surface 124 includes a rectangular cavity 125*a* having a generally flat bottom surface, two deep circular cavities 125*b* having generally flat bottom surfaces, a circular cavity 125*c* having a curved bottom surface, and a shallow circular cavity 125*d* with a generally flat bottom surface. The rectangular cavity 125*a* is sized and shaped to receive rectangular bottles and/or cleaning patches; the deep circular cavities 125*b* are sized and shaped to receive round solvent bottles; and the circular cavities 125*c-d* provide storage for small parts, such as screws. In other embodiments, the first portion 120 may not include the cavities 125, and/or the first portion 120 can have a different configuration.

The second portion 140 of the base 110 includes a length $L_2$, a longitudinal axis generally coaxial with the axis A-A of the base 110, a first end section 142*a* attached to the third portion 150, a second end section 142*b* opposite the first end section 142*a*, and an upper surface 144. The upper surface 144 is generally coplanar with the upper surface 124 of the first portion 120 and an upper surface 154 of the third portion 150. The length $L_2$ of the second portion 140 and the length $L_1$ of the fist portion 120 are each less than a total length $L_T$ of the base 110 when the first and second portions 120 and 140 are attached together.

Figure 2:
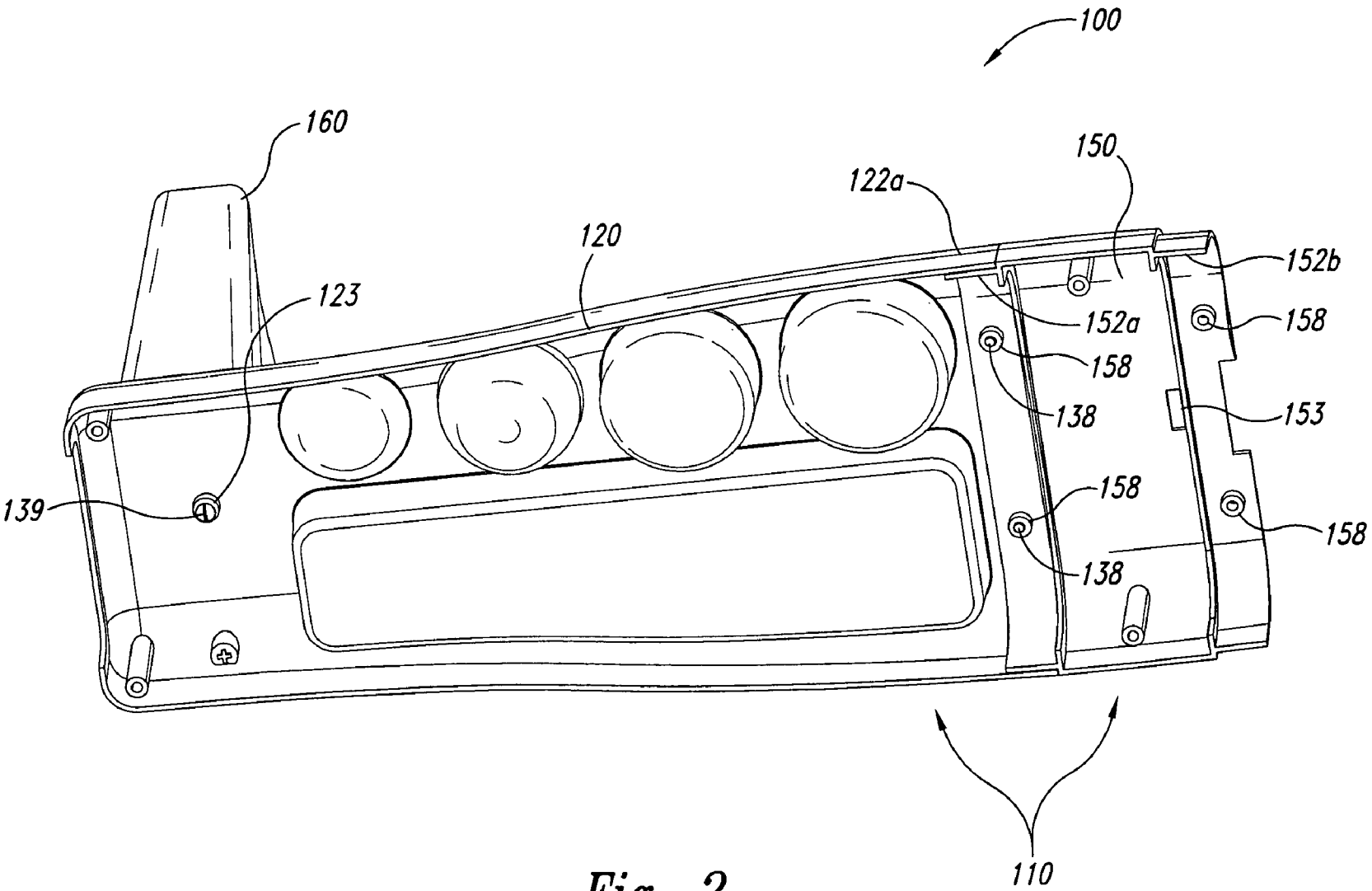
FIG. 2 is a schematic rear isometric view of the firearm supporting device with the second portion of the base removed to illustrate the connection between the first, second, and third portions of the base in accordance with one embodiment of the invention.

FIG. 2 is a schematic rear isometric view of the firearm supporting device 100 with the second portion 140 of the base 110 removed to illustrate the connection between the first, second, and third portions 120, 140, and 150 of the base 110 in accordance with one embodiment of the invention. The illustrated third portion 150 includes a first flange 152*a* and a second flange 152*b* opposite the first flange 152*a*. The first and second flanges 152*a-b* are recessed from the upper surface 154 (FIG. 1) and configured to interface with the first end sections 122*a* and 142*a* of the first and second portions 120 and 140, respectively. More specifically, when the first portion 120 is attached to the third portion 150, the first end section 122*a* is placed on the first flange 152*a* so that a plurality of apertures 123 (FIG. 1) in the first portion 120 are aligned with corresponding apertures 158 in the first flange 152*a*. Fasteners 138 can be placed in the apertures 123 and 158 to releasably attach the first portion 120 to the third portion 150. For example, the fasteners 138 can be bolts to which nuts may be attached. Alternatively, the apertures 158 in the first flange 152*a* can be sized to receive threaded bushings that are mounted to the third portion 150, and the fasteners 138 can interface with the threaded bushings. In either case, the fasteners 138 can be selectively removed with a tool or by hand without tools to decouple the first and third portions 120 and 150.

Referring back to FIG. 1, the illustrated second portion 140 is attached to the third portion 150 in a manner similar to the connection between the first and third portions 120 and 150. For example, the first end section 142*a* of the second portion 140 is placed on the second flange 152*b* (FIG. 2), and a plurality of fasteners 138 are received in apertures 143 in the second portion 140 and corresponding apertures 158 (FIG. 2) in the third portion 150. In other embodiments, the first, second, and third portions 120, 140, and 150 can be releasably attached via other mechanisms. In additional embodiments, the firearm supporting device 100 may not include the third portion 150, but rather the first and second portions 120 and 140 can be attached directly to each other. For example, in one such embodiment, the first or second portion 120 or 140 can include a flange that interfaces with the end section of the other portion.

The first support 160 is attached to the first portion 120 of the base 110 at the second end section 122*b* and projects from the upper surface 124. The first support 160 can be either (a) detachably coupled to the first portion 120 such that the first support 160 may be decoupled from the base 110, or (b) non-removably attached to the first portion 120 such that the first support 160 is configured to be attached to and not removed from the base 110. For example, in the illustrated embodiment, the first support 160 includes a threaded bushing (not shown), the first portion includes an aperture 123 (FIG. 2), and a fastener 139 (FIG. 2) is received in the aperture 123 and interfaces with the threaded bushing to releasably couple the first support 160 to the first portion 120. In other embodiments, the first support 160 can be an integral part of the first portion 120.

The illustrated first support 160 includes a body 162, a non-marring member 164 attached to the body 162, and a contact surface 166 on the non-marring member 164. The non-marring member 164 can be a pliable, rubber-like material to prevent marring of the firearm and provide a slip-resistant contact surface 166. The body 162 and non-marring member 164 can have a V-shaped configuration sized to receive the forward portion of the firearm. The V-shaped configuration centers the firearm and inhibits side-to-side movement of the firearm. In other embodiments, the first support 160 may have other configurations. For example, the first support 160 may have a height adjustment mechanism to change the distance between the contact surface 166 and the base 110. Moreover, the first support 160 may be movably attached to the first portion 120 and movable between two or more positions along the axis A-A of the base 110.

Figure 3:
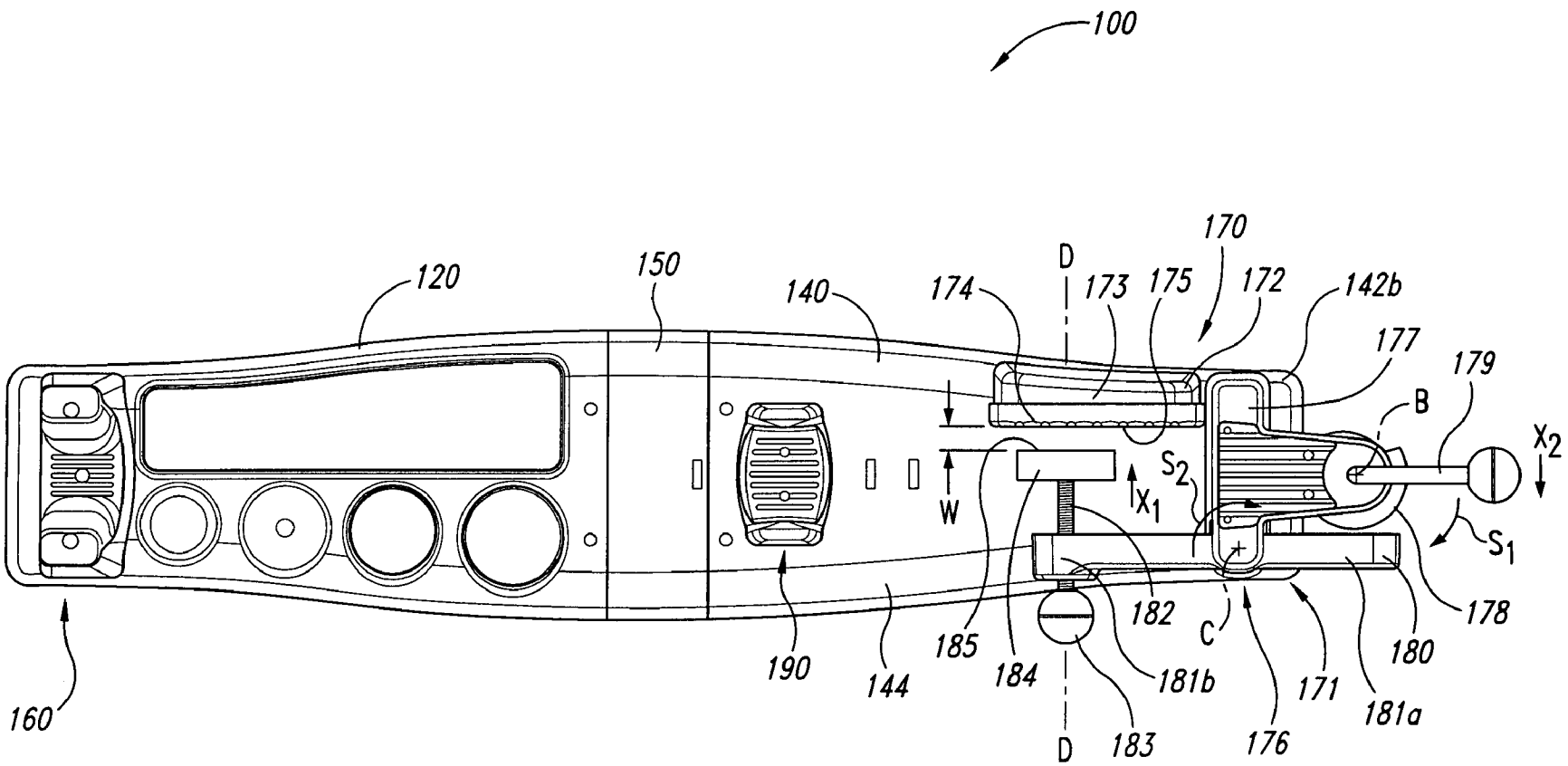
FIG. 3 is a schematic top plan view of the firearm supporting device of FIG. 1.

FIG. 3 is a schematic top plan view of the firearm supporting device 100 of FIG. 1. The second support 170 is coupled to the second portion 140 of the base 110 at the second end section 142*b* and projects from the upper surface 144. The illustrated second support 170 includes a clamping assembly 171 configured to selectively grasp a rearward portion (e.g., buttstock) of a firearm and inhibit movement of the firearm relative to the second portion 140 of the base 110. The clamping assembly 171 has a non-movable portion 172 and a movable portion 176 movable relative to the non-movable portion 172. The non-movable portion 172 includes a body 173, a non-marring member 174 attached to the body 173, and a contact surface 175 on the non-marring member 174. The body 173 can be detachably coupled or non-removably attached to the second portion 140 as described above with reference to the first support 160. Alternatively, the body 173 can be an integral component of the second portion 140. In either case, the illustrated body 173 and the non-marring member 174 are fixed (i.e., non-movable) relative to the second portion 140 when the non-movable portion 172 is attached to the second portion 140. In additional embodiments, both the non-movable portion 172 and the movable portion 176 can be movable relative to the second portion 140.

The movable portion 176 of the clamping assembly 171 includes a body 177, a cam 178 pivotably attached to the body 177 and rotatable about an axis B, a lever 179 attached to the cam 178, and a cam follower 180 pivotably attached to the body 177 and rotatable about an axis C. The body 177 can be detachably coupled or non-removably attached to the second portion 140 as described above with reference to the first support 160. The cam follower 180 has a first end portion 181*a* positioned to contact the cam 178 and a second end portion 181*b* opposite the first end portion 181*a*. The movable portion 176 further includes a threaded shaft 182, a handle 183 attached to one end of the threaded shaft 182, a contact member 184 attached to the other end of the threaded shaft 182, and a contact surface 185 on the contact member 184. The threaded shaft 182 interfaces with the second end portion 181*b* of the cam follower 180 such that rotation of the handle 183 about an axis D-D drives the contact member 184 in a direction $X_1$. As such, a user can adjust a distance W between the contact surfaces 175 and 185 to correspond to the size of the rearward portion of a particular firearm.

The movable portion 176 is movable between (a) a first position (shown in FIG. 3) in which the clamping assembly 171 releases the firearm and the firearm can be removed from the second support 170, and (b) a second position (not shown) in which the clamping assembly 171 clamps the firearm. A user can move the movable portion 176 from the first position to the second position by pushing the lever 179 in a direction $X_2$, which pivots the cam 178 in a direction $S_1$ about the axis B, which in turn pivots the cam follower 180 in a direction $S_2$ about the axis C, which drives the threaded shaft 182 and the contact member 184 in the direction $X_1$. The cam 178 may include a detent to retain the cam 178 and the movable portion 176 in the second position until the user exerts a force on the lever 179 to pivot the cam 178 back to the first position. In other embodiments, the second support 170 can have other configurations that may or may not include a clamping assembly. For example, the second support 170 may have a height adjustment mechanism to change the distance between the contact surfaces 175 and 185 and the base 110. Moreover, the second support 170 may be movably attached to the second portion 140 and movable between two or more positions along the axis A-A of the base 110.

Figure 4:
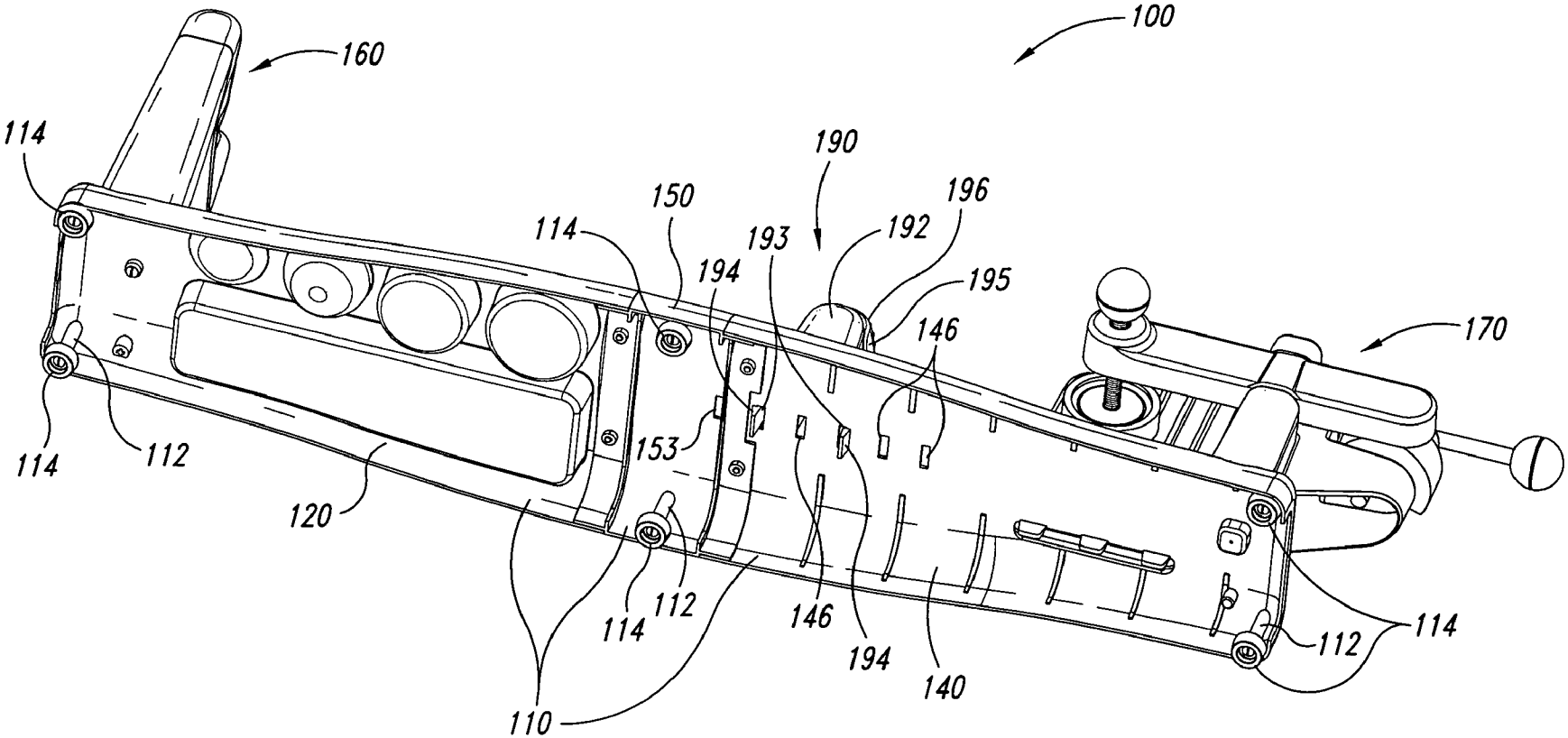
FIG. 4 is a schematic rear isometric view of the firearm supporting device of FIG. 1.

FIG. 4 is a schematic rear isometric view of the firearm supporting device 100 of FIG. 1. Referring to both FIGS. 1 and 4, the third support 190 includes a body 192, a non-marring member 195 attached to the body 192, and a contact surface 196 on the non-marring member 195 that is positioned to contact the firearm. The illustrated third support 190 can be removably connected to the second and/or third portion 140 and/or 150 of the base 110 at one of several different positions. Specifically, the second portion 140 includes a plurality of apertures 146 at the first end section 142*a*, the third portion 150 includes an aperture 153 generally aligned with the apertures 146, and the body 192 of the third support 190 includes two arms 193 sized to be received in a corresponding pair of apertures 146 and/or 153. The individual arms 193 can include a head 194 at the distal end that inhibits the third support 190 from inadvertently decoupling from the base 110. For example, the heads 194 can project from the arms 193 and contact the second and/or third portions 140 and/or 150 adjacent to the apertures 146 and/or 153 to inhibit the arms 193 from sliding out of the apertures 146 and/or 153. A user can press the two arms 193 toward each other to selectively detach the third support 190 from the base 110. The user can accordingly attach the third support 190 to the base 110 at any one of a plurality of positions to accommodate firearms with different sizes and/or configurations. In additional embodiments, the firearm supporting device 100 may not include the third support 190, or the third support 190 can have a different configuration.

The illustrated base 110 further includes a plurality of projections 112 and a plurality of feet 114 attached to corresponding projections 112. The projections 112 can include threaded bushings that receive corresponding threaded shafts of the feet 114. As such, in several applications, the feet 114 can be detached from the base 110 and fasteners can attach the base 110 to a table. For example, the fasteners can project from a surface of the table and threadably engage the bushings in corresponding projections 112. The feet 114 may include a non-skid material to inhibit movement of the base 110 relative to an external support surface on which the firearm supporting device 100 rests.

The first, second, and third portions 120, 140, and 150 of the base 110 can be manufactured as separate components by injection molding or other suitable processes. After manufacturing, the first, second, and third portions 120, 140, and 150 can be placed in a container (e.g., a box) along with the first, second, and third supports 160, 170, and 190 and shipped to a customer, distributor, or store for retail sale. An advantage of the illustrated firearm supporting device 100 is that the components may be packaged and shipped, stored, and/or transported in a disassembled state. For example, the first, second, and third portions 120, 140, and 150 of the base 110 and the first, second, and third supports 160, 170, and 190 can be placed in a shipping container with the components detached from each other. This is expected to reduce the cost to ship the supporting device 100 because shipping rates are based in part on the volume of the package. In other embodiments, however, the device 100 can be stored and/or packaged and shipped with some or all of the components attached.

C. Additional Embodiments of Firearm Supporting Devices

Figure 5:
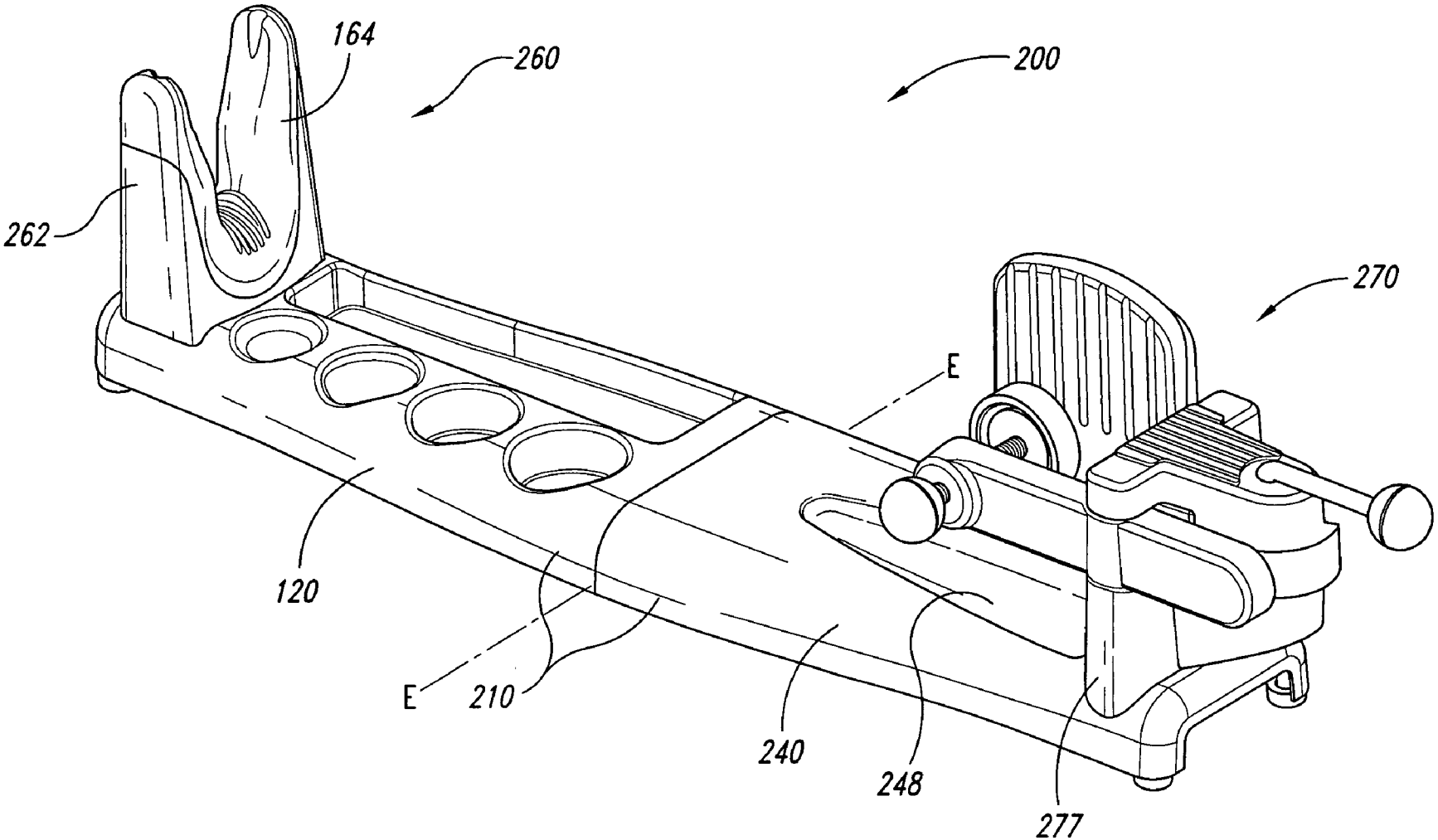
FIG. 5 is a schematic isometric view of a firearm supporting device in accordance with another embodiment of the invention.

FIG. 5 is a schematic isometric view of a firearm supporting device 200 in accordance with another embodiment of the invention. The firearm supporting device 200 is generally similar to the firearm supporting device 100 described above with reference to FIGS. 1-4. For example, the illustrated device 200 includes a base 210, a first support 260 attached to the base 210, and a second support 270 attached to the base 210. The illustrated device 200, however, does not include a third support attached to the base 210. In additional embodiments, the device 200 may include a third support attached to the base 210 for supporting the firearm. In either case, the illustrated base 210 includes a first portion 120 and a second portion 240 attached directly to the first portion 120. As such, the base 210 does not include a third portion positioned between the first and second portions 120 and 240. In one embodiment, the first and second portions 120 and 240 can be attached together with a hinge such that the portions 120 and 240 can pivot toward each other about an axis E for storage, shipping, or transport. In additional embodiments, however, the base 210 may have other configurations including a handle for carrying the device 200 and/or a third portion attached between the first and second portions 120 and 240. The illustrated second portion 240 includes a recess 248 sized to partially receive the rearward portion of the firearm. For example, the illustrated recess 248 is sized and configured to partially receive the buttstock of a rifle. Because a portion of the firearm is received in the recess 248, the body 262 of the first support 260 and the body 277 of the second support 270 can have a reduced height relative to the corresponding supports on the firearm supporting device 100 described above with reference to FIGS. 1-4. The reduced height of the first and second supports 260 and 270 advantageously reduces the height or profile of the device 200. In additional embodiments, the first and/or second supports 260 and 270 can be pivotably coupled to the base 210 and movable between a deployed position (shown in FIG. 5) and a stowed position (not shown) in which the supports 260 and 270 are folded against the base 210.

From the foregoing, it will be appreciated that specific embodiments of the invention have been described herein for purposes of illustration, but that various modifications may be made without deviating from the invention. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A firearm supporting device for supporting a firearm having a first section and a second section spaced apart from the first section, the supporting device comprising:

a base having a first portion separable from a second portion, a third portion configured to connect the first and the second portion, the second portion configured to be releasably attached to a first side of the third portion, wherein the first portion is fixable relative to a second side opposite the first side of the third portion when the first and second portions are releasably attached to the third portion;

a first support for carrying the first section of the firearm, the first support being configured to project from the first portion of the base; and a second support for carrying the second section of the firearm, the second support being configured to project from the second portion of the base.

2. The firearm supporting device of claim 1 wherein:

the second support comprises a clamp assembly including a cam and a lever operably coupled to the cam, the clamp assembly being configured to contact the second section of the firearm and selectively inhibit movement of the firearm relative to the second portion of the base;

the first portion of the base comprises a first axis and a first length along the first axis;

the second portion of the base comprises a second axis and a second length along the second axis;

the first and second axes are generally coaxial when the first and second portions are attached;

the base further comprises a minimum length greater than the first or second lengths when the first portion is attached to the second portion;

the first support is detachably coupled to the first portion of the base; and the second support is detachably coupled to the second portion of the base.

3. The firearm supporting device of claim 1 wherein the first portion of the base is detachably coupled to the third portion.

4. The firearm supporting device of claim 1 wherein the first portion of the base is hingedly coupled to the third portion.

5. The firearm supporting device of claim 1 wherein:

the first support is detachably coupled to the first portion of the base; and the second support is detachably coupled to the second portion of the base.

6. The firearm supporting device of claim 1 wherein the third portion is configured to be attached to the first and second portions and positioned between the first and second portions.

7. The firearm supporting device of claim 1 wherein the third portion includes a third support for carrying a third section of the firearm between the first and second sections, the third support being configured to project from the second portion of the base.

8. The firearm supporting device of claim 1 wherein the third portion includes a third support for carrying a third section of the firearm, the third support being detachably coupled to the second portion of the base at one of two or more different positions.

9. The firearm supporting device of claim 1 wherein:

the first portion of the base further comprises a plurality of first apertures positioned to receive corresponding fasteners for connecting the first and third portions; and the second portion of the base further comprises a plurality of second apertures positioned to receive corresponding fasteners for connecting the second and third portions.

10. The firearm supporting device of claim 1 wherein the second support is configured to selectively inhibit movement of the firearm relative to the second portion of the base.

11. The firearm supporting device of claim 1 wherein the first portion of the base has a first upper surface and the second portion of the base has a second upper surface generally coplanar with the first upper surface when the first and second portions are attached.

12. The firearm supporting device of claim 1 wherein the first portion of the base has a first axis and the second portion of the base has a second axis generally coaxial with the first axis when the first and second portions are attached.

13. A firearm supporting device for supporting a firearm having a first section and a second section spaced apart from the first section, the supporting device comprising:

a base including a first portion, a second portion and a third portion, wherein the third portion is removably attached to the first portion and the second portion, the first portion having a first length and the second portion having a second length, wherein the base has a minimum length greater than either the first or second lengths when the first portion is attached to the second portion;

a first support attached to the first portion of the base, the first support being configured to support the first section of the firearm; and a second support attached to the second portion of the base, the second support being configured to support the second section of the firearm.

14. The firearm supporting device of claim 13 wherein the second support comprises a clamp assembly configured to contact the second section of the firearm and selectively inhibit movement of the firearm relative to the second portion of the base.

15. The firearm supporting device of claim 13 wherein the first portion of the base is fixed relative to the second portion.

16. The firearm supporting device of claim 13 wherein the first portion of the base is detachably coupled to the third portion.

17. The firearm supporting device of claim 13 wherein the first and second portions of the base are disposed along a longitudinal axis.

18. The firearm supporting device of claim 13 wherein the second portion of the base comprises a recess sized to receive a portion of a stock of the firearm.

19. A firearm supporting device for supporting a firearm having a first section and a second section spaced apart from the first section, the supporting device comprising:

a base including a first portion, a third portion and a second separable portion releasably attachable to the third portion;

a first support attachable to the first portion of the base, the first support being configured to support the first section of the firearm; and a second support attachable to the second portion of the base, the second support including a clamp assembly having a cam and a cam follower positioned proximate to the cam, the clamp assembly being configured to contact the second section of the firearm and selectively inhibit movement of the second section of the firearm relative to the second portion of the base.

20. The firearm supporting device of claim 19 wherein the clamp assembly further comprises a lever coupled to the cam, a first contact member coupled to the cam follower, and a second contact member fixedly attached to the second portion of the base, wherein the first and second contact members are positioned to clamp the second section of the firearm.

21. The firearm supporting device of claim 19 wherein the first portion of the base is fixed relative to the second portion when the first, second and third portions are attached.

22. The firearm supporting device of claim 19 wherein the first portion of the base is detachably coupled to the third portion.

23. The firearm supporting device of claim 19 wherein the first and second portions of the base comprise a plurality of feet for contacting an external surface.

24. The firearm supporting device of claim 19 wherein the first portion of the base and the second portion of the base are coaxial along a longitudinal axis.

25. The firearm supporting device of claim 19 wherein:

the first support is detachably coupled to the first portion of the base; and the second support is detachably coupled to the second portion of the base.

* * * * *